US008503918B2

(12) United States Patent
Koshida

(10) Patent No.: US 8,503,918 B2
(45) Date of Patent: Aug. 6, 2013

(54) IMAGE HEATING APPARATUS

(75) Inventor: Kohei Koshida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 307 days.

(21) Appl. No.: 12/971,773

(22) Filed: Dec. 17, 2010

(65) Prior Publication Data

US 2011/0150546 A1 Jun. 23, 2011

(30) Foreign Application Priority Data

Dec. 22, 2009 (JP) ..... 2009-290493

(51) Int. Cl.
*G03G 15/20* (2006.01)
*H05B 11/00* (2006.01)

(52) U.S. Cl.
USPC ..... 399/329; 399/67; 399/122; 399/320; 399/328; 399/336; 219/216; 219/601; 219/618; 219/619

(58) Field of Classification Search
USPC ..... 399/67, 122, 320, 328, 329, 336, 399/338; 219/216, 619, 601, 618
See application file for complete search history.

(56) References Cited

U.S. PATENT DOCUMENTS

| | | | | |
|---|---|---|---|---|
| 5,682,580 | A | 10/1997 | Iwama et al. | |
| 6,725,009 | B1 * | 4/2004 | Tatematsu et al. | 399/329 |
| 6,937,827 | B2 | 8/2005 | Katoh et al. | |
| 7,079,800 | B2 * | 7/2006 | Asakura et al. | 399/328 |
| 7,424,259 | B2 * | 9/2008 | Samei et al. | 399/329 |
| 7,570,910 | B2 * | 8/2009 | Ishii | 399/329 |
| 7,609,991 | B2 | 10/2009 | Koshida | |
| 8,351,833 | B2 | 1/2013 | Koshida | |
| 2002/0168202 | A1 * | 11/2002 | Izawa et al. | 399/329 |
| 2005/0074251 | A1 | 4/2005 | Katoh et al. | |
| 2006/0285893 | A1 * | 12/2006 | Ishii | 399/329 |
| 2010/0086335 | A1 * | 4/2010 | Sugaya | 399/329 |
| 2010/0178088 | A1 | 7/2010 | Koshida et al. | |

FOREIGN PATENT DOCUMENTS

| | | |
|---|---|---|
| JP | 8-137308 | 5/1996 |
| JP | 8-137331 | 5/1996 |
| JP | 2001-142327 | 5/2001 |
| JP | 2004-61733 | 2/2004 |
| JP | 2006-259039 | 9/2006 |
| JP | 2006-350054 | 12/2006 |
| JP | 2007-79238 | 3/2007 |

* cited by examiner

*Primary Examiner* — David Gray
*Assistant Examiner* — Francis Gray
(74) *Attorney, Agent, or Firm* — Fitzpatrick, Cella, Harper & Scinto

(57) ABSTRACT

An image heating apparatus includes a belt unit, a coil unit, a rotatable driving member, and positioning and urging mechanisms. The belt unit includes an endless belt to heat a toner image on a sheet at a nip portion. The coil unit opposes an outer surface of the belt and generates a magnetic flux for heating the belt. The driving member rotates the belt and forms the nip portion with the belt. The positioning mechanism positions the coil unit with respect to the belt unit and includes two positioning portions on each side of the coil unit with respect to a longitudinal direction thereof. The urging mechanism urges the coil unit toward the belt unit. The coil unit is supported by the belt unit at three of the four positioning portions.

15 Claims, 8 Drawing Sheets

(a)

(b)

IMAGE HEATING APPARATUS

FIELD OF THE INVENTION AND RELATED ART

The present invention relates to an image heating apparatus of the electromagnetic-induction heating type, which is suitable as an image heating apparatus to be mounted in an image forming apparatus, such as a copying machine, a printer, a facsimile machine, and a multifunction machine of these machines, which forms an image with the use of one of the electrophotographic, electrostatic, and magnetic image forming processes, and the like. Examples of the image heating apparatus may include a fixing device for fixing or temporarily fixing an unfixed image on a recording material and a gloss increasing device for increasing the glossiness of an image by heating the image fixed on the recording material.

In the image forming apparatus mentioned above, a heating-roller-type device (apparatus) has been widely used as the fixing device (image heating apparatus) for heating an unfixed toner image on the recording material. This device includes a fixing roller (rotatable heating member or heating roller) and a pressing roller (rotatable pressing member), which are rotated together while being pressed against each other, forming thereby a press-contact portion (nip). In the nip, the recording material on which an unfixed toner image is carried is subjected to the application of heat and pressure while being nip-conveyed. As a result, the toner image is melted and fixed on the recording material. In such a fixing device, a method has been proposed in which an eddy current is generated in an induction-heat generating element provided, as a means for heating the fixing roller, on an inner surface of the fixing roller, by a magnetic field generated by an exciting coil to generate heat through Joule heat. In this method, a heat generating source can be placed very close to the toner and therefore compared with the conventional heating-roller type of apparatus using a halogen lamp, the method has the advantage that the time required for increasing the temperature of a surface of the fixing roller up to a proper driving-actuation fixing temperature of the fixing roller can be reduced. Further, the method also has the advantage that the heat transfer path from the heat generating source to the toner is short and simple, and therefore, heat efficiency is high.

Japanese Laid-Open Patent Application (JP-A) 2007-79238 discloses a constitution using a fixing device in which an electroconductive layer is provided in a fixing belt member for energy saving and heat is generated by electromagnetic induction heating. In this constitution, an induction heating means is fixed on a fixing-device frame which supports a fixing belt and a pressing roller. Further, in the constitution described in JP-A 2006-259039, the fixing device can be driven from a pressing-roller side. In this constitution, in order to realize constant backlash between driving members, the pressing-roller-side member is supported by the fixing-device frame and a unit for supporting the fixing belt (fixing belt unit) is urged by an urging spring in many cases. In this constitution, the fixing belt unit is urged toward the pressing roller, so that the position of the fixing belt unit is changed or varied due to a change or variation in hardness of the pressing roller by continuous use. For this reason, the positional relationship between the induction heating means and the fixing belt cannot be maintained, so that heat generating efficiency is lowered in some cases. Therefore, in order to maintain the positional relationship between the induction heating means and the fixing belt, it would be considered that a constitution for connecting (positionally aligning) the induction heating means and the fixing belt unit with each other is employed.

However, when the induction heating means is directly fixed on the fixing-device frame with a screw or the like, warpage (torsion) of the induction heating means generated by heat or the like influences the nip formed between the fixing belt and the pressing roller. For that reason, the shape of the nip was unable to be kept constant to cause creases of paper (recording material). Further, when the induction heating means is directly fixed on the fixing belt unit with a screw or the like, warpage (torsion) of the induction heating means generated by heat or the like considerably influences the nip which is directly constituted by the fixing belt unit. For that reason, the shape of the nip was unable to be kept constant to the cause creases in the paper.

SUMMARY OF THE INVENTION

A principal object of the present invention is to provide an image heating apparatus capable of reducing the degree of heat generation non-uniformity by warpage (torsion) caused by heat or the like of an induction heating means.

According to an aspect of the present invention, there is provided an image heating apparatus comprising:

a belt unit including a belt;

a coil unit, provided opposed to an outer surface of the belt, including a coil for generating a magnetic flux for heating the belt;

a pressing member for forming a nip, in which a recording material is to be heated, between itself and the belt;

a positioning portion, provided on the coil unit, for positioning the coil unit with respect to the belt unit;

a portion to be positioned, provided on the belt unit, for being engaged with the positioning portion; and elastic means for urging the coil unit toward the belt unit.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Image Forming Apparatus

Figure 1:
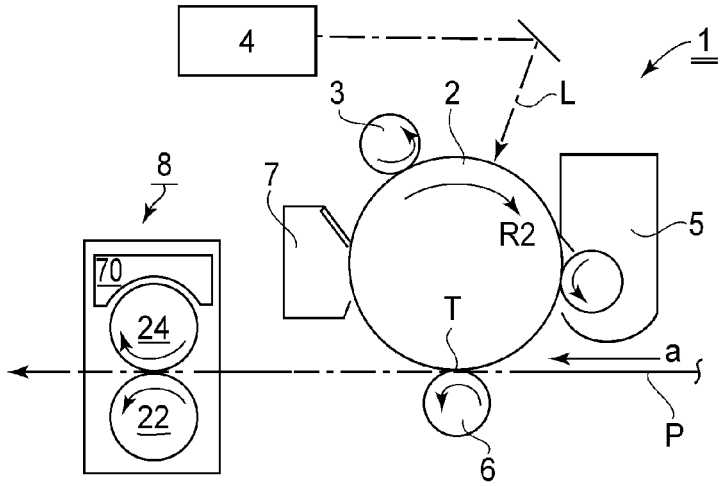
FIG. 1(*a*) is a schematic sectional view of an example of an image forming apparatus, and FIG. 1(*b*) is a perspective view of a fixing device as seen from a front surface side (recording-material entrance side).
Figure 1:
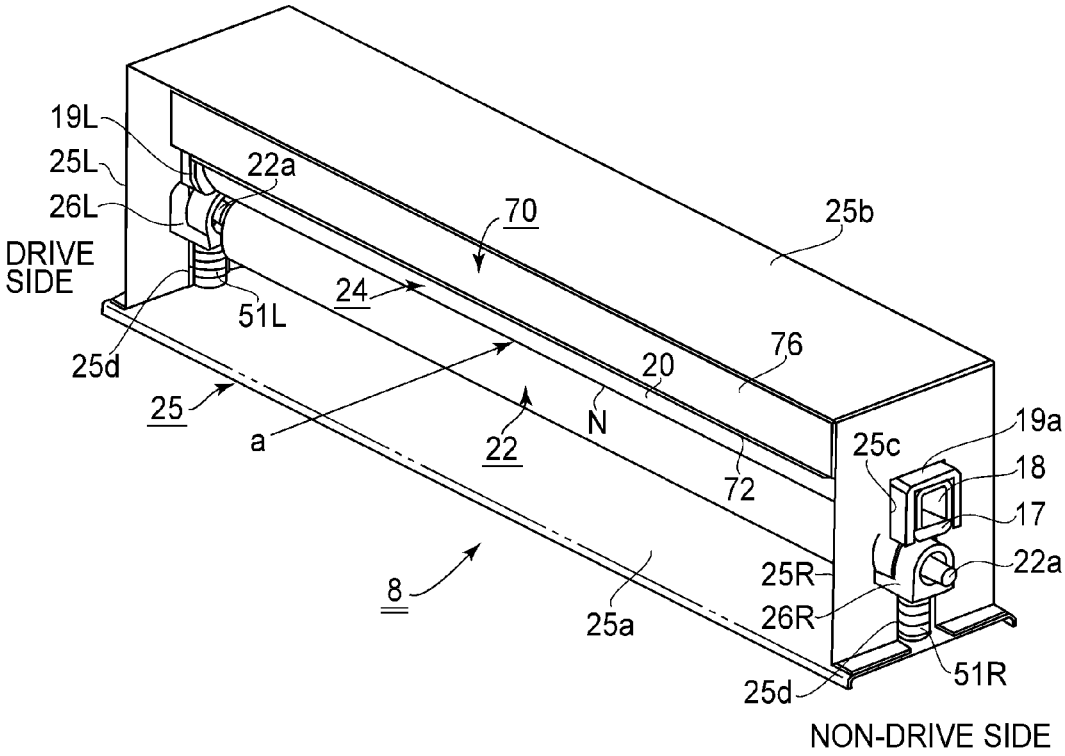

FIG. 1A is a schematic sectional view of an example of an image forming apparatus in which an image heating apparatus in accordance with the present invention is mounted as a fixing device 8. The apparatus 1 is a laser (beam) printer utilizing an electrophotographic process of a transfer type. A rotatable drum-type electrophotographic photosensitive member 2 as an image bearing member (hereinafter referred to as a drum) is rotationally driven in the clockwise direction indicated by an arrow R2 at a predetermined peripheral speed. A contact charging roller 3 as a charging means electrically charges uniformly an outer peripheral surface of the rotating drum 2 to a predetermined polarity and a predetermined potential. A laser scanner 4 as an exposure means outputs laser light L modulated correspondingly to a time-serial electrical electric digital pixel signal of image information, so that the uniformly charged surface of the rotating drum 2 is subjected to scanning exposure to the laser light L. As a result, an electrostatic latent image corresponding to a scanning exposure pattern is formed on the drum surface. A developing device 5 develops the electrostatic latent image on the drum surface into a toner image by reverse development or normal development. A transfer roller 6 as a transfer means is contacted to the drum 2 with a predetermined urging force to form a transfer portion (transfer nip) T. To the transfer portion T, a recording material P is fed from an unshown sheet feeding mechanism portion with a predetermined control timing and is nip-conveyed through the transfer portion T. To the transfer roller 6, a predetermined transfer bias is applied with predetermined control timing. As a result, the toner image is successively transferred electrostatically from the drum surface onto the surface of the recording material P, which is nip-conveyed through the transfer portion T. The recording material coming out of the transfer portion T is separated from the drum surface and is introduced into the fixing device 8. The fixing device heats and presses an unfixed toner image on the recording material P, thus fixing the unfixed toner image on the recording material P as a fixed image. Then, the recording material P is discharged onto a sheet discharge portion as an image-formed product. Transfer residual toner remaining on the drum after the separation of the recording material P is removed by a drum cleaning device 7. The drum surface cleaned by removing the transfer residual toner therefrom is repetitively subjected to image formation. An arrow a represents a conveyance direction of the recording material P.

<Fixing Apparatus>

Figure 2:
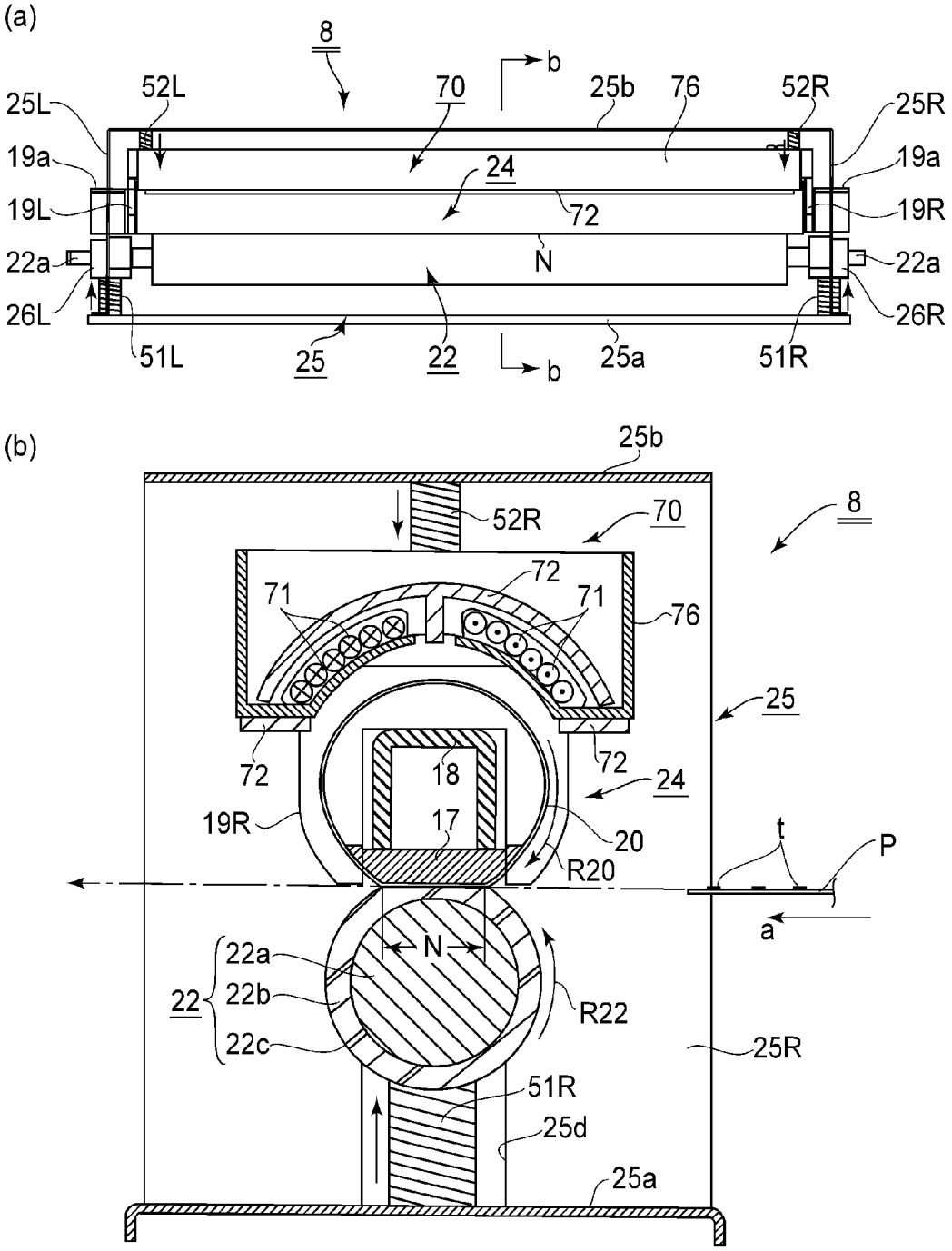
FIG. 2(*a*) is a schematic front view of the fixing device, and FIG. 2(*b*) is an enlarged cross-sectional left side view taken along b-b line indicated in FIG. 2(*a*).
Figure 3:
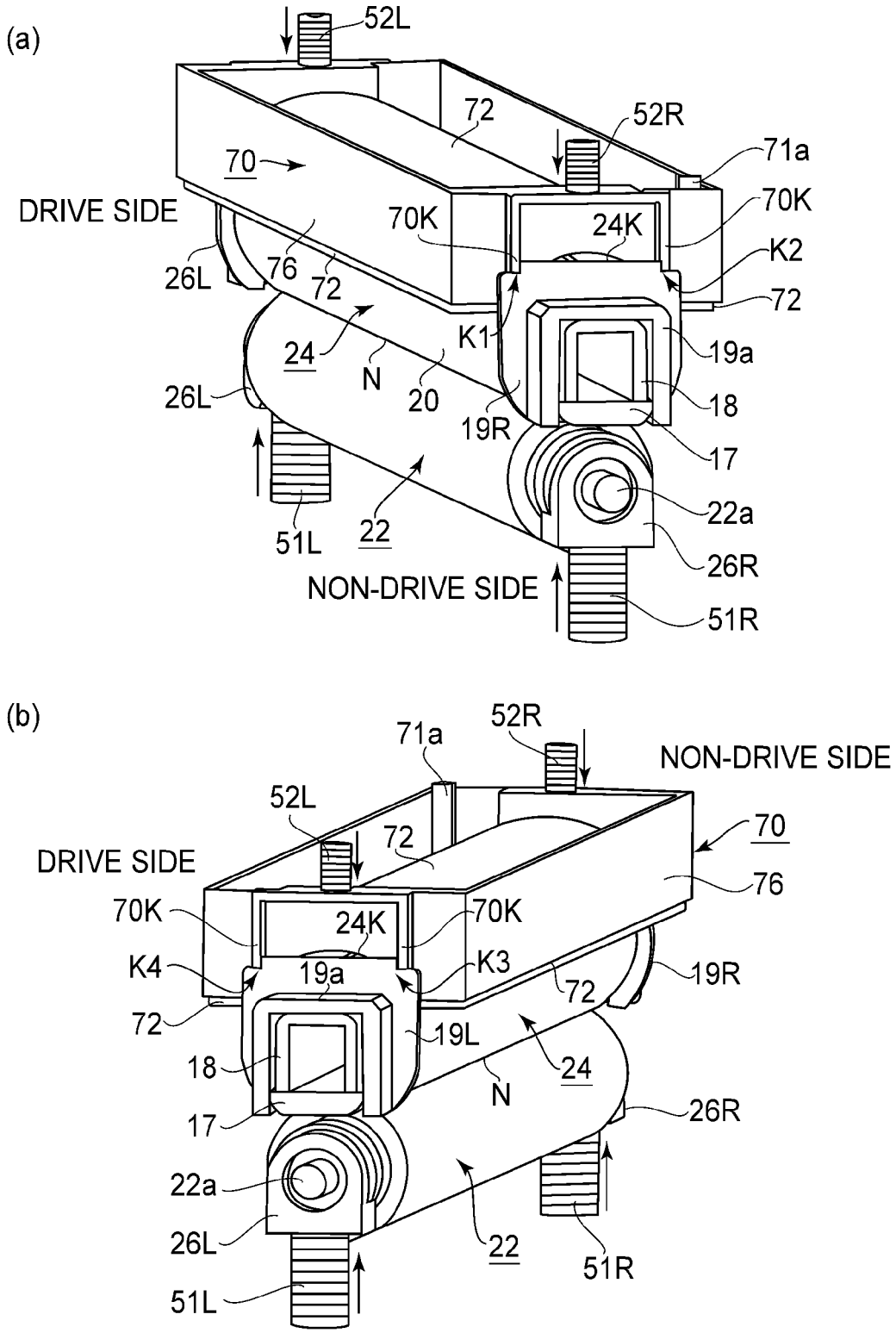
FIG. 3(*a*) is a schematic perspective view of an assembly portion in a fixing-device frame as seen from a non-driving side, and FIG. 3(*b*) is a schematic perspective view of the assembly portion as seen from a driving side.

In the following description, the "front surface (side)" of the fixing device 8 as the image heating apparatus or members constituting the fixing device 8 is the surface which is viewed from a recording-material entrance side of the fixing device 8, and the "rear surface (side)" is the surface (recording-medium exit side) opposite from the "front surface". Further, with respect to the fixing device 8 and the members constituting the fixing device 8, the "left and right" are those as seen from the front surface side of the fixing device 8. Further, the "longitudinal direction" means the direction parallel to the axial line of any of the rotatable members, or the direction perpendicular to the direction in which the recording material P is conveyed on the recording-material-conveyance-passage surface. Further, the "widthwise direction" means the direction perpendicular to the longitudinal direction. The "upstream and downstream sides" are those with respect to the recording-material conveyance direction. In this embodiment, the left side is a driving side and the right side is a non-driving side. Moreover, the recording-sheet size (paper width) or the sheet-passing width of the recording material P means a dimension of the recording material P with respect to the direction perpendicular to the recording-material conveyance direction. FIG. 1(*b*) is a perspective view of the fixing device 8 as seen from the front side (recording medium entrance side) of the fixing device 8. FIG. 2(*a*) is a schematic front view of the fixing device 8, and FIG. 2(*b*) is an enlarged longitudinal left side view of the fixing device 8 taken along b-b line indicated in FIG. 2(*a*). FIG. 3(*a*) is a schematic perspective view of an assembly portion in the fixing-device frame as seen from the non-driving side, and FIG. 3(*b*) is schematic perspective view of the assembly portion as seen from the driving side. The fixing device 8 includes a belt unit 24, an induction heating means (magnetic flux generating means, hereinafter referred to as a coil unit) 70, a pressing member 22, and the like which are mounted on a fixing-device frame (casing) 25. The frame 25 is a metal plate frame, extending in a left-right direction, including a bottom plate 25*a*, a left side plate 25L, a right side plate 25R and a top plate 25*b*.

The belt unit 24 includes a belt (fixing belt) 20, which is a rotatable and has an endless, cylindrical or sleeve-like shape, as an induction-heat generating member for generating heat by the action of magnetic flux. In this embodiment, the belt 20 is a flexible composite-layer belt including a metal sleeve (metal layer or electroconductive layer) formed by electrocasting and an elastic layer provided on an outer peripheral surface of the metal sleeve. The amount of magnetic flux generated by the coil unit 70 that is confined to the metallic portion of the belt 20 can be increased by using a ferromagnetic metal (metal which is high permeability), such as iron or nickel, in the metal sleeve. In other words, heat can be efficiently generated in the belt 20 by generating an eddy current in the surface layer of the metallic portion of the belt 20 by increasing the metallic portion in magnetic flux density. The belt 20 has a length (dimension) larger than a sheet-passing width of a maximum-size recording material which is passable through the fixing device 8. Inside the belt 20 are provided, a fixing pad 17, which is inserted into the belt 20 and has heat-resisting property and rigidity as a back-up member, and a rigid stay 18, which is also inserted into the belt 20 and has an inverted U-like cross section. The stay 18 is located on an upper surface of the pad 17. The belt 20 is externally engaged loosely with the pad 17 and the stay 18. The lengths (dimensions) of the pad 17 and the stay 18 are longer than the length (dimension) of the belt 20, and left and right end portions of each of the pad 17 and the stay 18 are outwardly projected from those of the belt 20. Further, on left and right outwardly projected portions of the stay 18, flange members 19L and 19R are engaged and fitted, respectively. The flange members 19L and 19R are preventing means for preventing level movement of the belt 20 in a longitudinal (generatrix) direction. The coil unit 70 includes an exciting coil 71, a magnetic core 72, a holder (housing) 76 for holding the coil 71 and the core 72, and the like. The holder 76 is an elongated box-like molded product composed of a heat-resistant resin, and the left-right direction thereof is its longitudinal direction. The holder 76 opposes the belt 20 on its bottom plate side. The bottom plate of the holder 76 is curved inward so as to follow the upper surface portion of the outer peripheral surface of the belt 20. That is, the holder 76 is disposed opposed to the belt 20 with a predetermined gap on its bottom plate side. In other words, the coil unit 70 is provided in the neighborhood of the surface layer of the belt 20.

The coil 71 has a substantially elliptical shape (elongated boat shape) with respect to its longitudinal direction and is disposed inside the holder 76 so as to follow the outer peripheral surface of the belt 20 while being contacted to the inner surface of the bottom plate which is curved inwardly. As a core wire of the coil 71, Litz wire prepared by bundling approximately 80-160 strands of fine wires having a diameter of 0.1-0.3 mm is used. As the fine wires, insulation coating electric wires are used. The Litz wire is wound 8 to 12 times around magnetic cores 72 to constitute the coil 71. To the coil 71, an exciting circuit (not shown) is connected, so that an alternating current can be supplied to the coil 71.

The cores 72 are disposed along the longitudinal direction of the belt 20 and are configured to cover the winding central portion and its peripheral portions of the coil 71. The cores 72 perform the function of efficiently introducing AC magnetic flux generated from the coil 71 into the metal layer constituting the belt 20. That is, the cores 72 are used for an increase in efficiency of the magnetic circuit 101 and for magnetic shielding. As a material for the cores 72, a magnetic material, such as a ferrite, having high permeability and low residual magnetic flux density, may preferably be used. The pressing member 22 in this embodiment is a pressing roller as a rotatable member having elasticity. The pressing roller 22 is prepared by forming an about 3 mm-thick silicone rubber layer 22*b* on a metal core 22*a* of stainless steel through injection molding and then by coating the silicone rubber layer 22*b* with a PFA resin tube 22*c* of about 40 μm in thickness.

In the belt unit 24, stay covering portions 19*a* outside the left and right flange members 19L and 19R are engaged in window holes 25*c* provided opposed to the left and right side plates 25L and 25R. The left and right end portions of each of the stay 18 and the pad 17 extend to the stay covering portions 19*a* of the left and right flange members 19L and 19R, respectively. As a result, the belt unit 24 is positioned and supported by the frame 25 in a state in which the pad 17 is directed downward. That is, the belt unit 24 is positioned and supported between the left and right side plates 25L and 25R of the frame 25. The roller 22 is disposed parallel to the belt unit 24 on a lower side of the belt unit 24, and the left and right end portions of the metal core 22*a* are rotatably held by bearing members 26L and 26R provided on the left and right side plates 25L and 25R, respectively. The bearing members 26L and 26R are slidably disposed vertically along vertical elongated holes 25*d* provided opposed to the left and right side plates 25L and 25R, respectively. Further, the left and right bearing members 26L and 26R are urged upward by urging springs 51L and 51R provided compressedly between the bottom plate and the bearing members 26L and 26R, respectively. As a result, the roller 22 is urged against the belt 20 toward the lower surface of the pad 17 with a predetermined urging force. In this embodiment, the roller 22 is urged against the belt 20, against elasticity of the elastic layer of the belt, toward the lower surface of the pad 17 with a force of 98 N (10 kgf) on one side, i.e., with a total pressure of 196 N (20 kgf). As a result, between the belt 20 and the roller 22, with respect to a recording-material conveyance direction a, a fixing nip N with a predetermined width necessary for heat-fixation, is formed. The coil unit 70 is disposed above and parallel to the belt unit 24 and is urged toward the belt unit 24 by elastic springs (elastic members) 52L and 52R, each provided compressedly between the coil unit 70 and the top plate 25*b* of the frame 25. The coil unit 70 urged toward the belt unit 24 is positioned in a state in which abutting portions 70K of the coil unit 70 abut against abutting portions 24K of the belt unit 24. This will be described later.

A fixing operation is as follows. The belt 20 is rotationally driven in the clockwise direction indicated by an arrow R20 in FIG. 2(*b*) at a predetermined peripheral speed by a driving force from a driving means (not shown). Although the driving means for the belt 20 is omitted from illustration in the figures for avoiding complication, in this embodiment, the driving means is configured so that a driving gear is engaged with a tooth-like inner surface of the belt 20. A rotational force acts on the roller 22 by press-contact frictional force in the nip N between the outer surface of the belt 20 and the roller 22 by rotationally driving the belt 20, so that the roller 22 is rotated by the rotation of the belt, thus being placed in a rotation state. Onto the inner surface of the belt 20, a grease is applied, so that a sliding property between the pad 17 and the inner surface of the belt 20 is ensured. The belt 20 is rotationally driven and by the rotation of the belt 20, the roller 22 is rotated in the counterclockwise direction indicated by an arrow R22. Further, energization to the coil 71 is performed by an exciting circuit (not shown). As a result, induction heat generation of the metal layer of the belt is made by a magnetic field generated by the coil 71, so that the belt 20 is increased in temperature. That is, the coil 71 generates alternating magnetic flux by an alternating current supplied from the exciting circuit. The alternating magnetic flux is guided by the coil 72 and acts on the metal layer of the belt 20, thus generating eddy current in the metal layer. The eddy current generates Joule heat by a specific resistance of metal. Thus, by supplying the alternating current to the coil 71, the belt 20 causes the electromagnetic induction heat generation by the action of the generated magnetic flux. Then, a surface temperature of the belt 20 is detected by a temperature detecting means (not shown).

Electrical information on the detected temperature outputted from the temperature detecting means is inputted into a control portion (not shown). The control portion controls the exciting circuit so that the belt temperature is increased and kept at a target temperature (fixing temperature) on the basis of the detected temperature information from the temperature detecting means. That is, the control portion controls the electric power supply (energization) from the AC exciting circuit to the coil 71. In the above-described manner, the belt 20 and the roller 22 are rotated and the belt 20 is temperature-controlled so as to increase in temperature up to the preset (target) fixing temperature. In this state, the recording material P carrying and conveying thereon unfixed toner images t is introduced into the fixing nip N with a toner-image carrying surface directed toward the belt 20 side. The recording material P intimately contacts the outer peripheral surface of the belt 20 in the fixing nip N and is nip-conveyed through the fixing nip N together with the belt 20. As a result, heat of the belt 20 is applied to the recording material P and the recording material P is subjected to the application of the nip pressure, so that the unfixed toner images t are heat-fixed on the surface of the recording material P as a fixed image.

Next, with reference to FIGS. 3(*a*) and 3(*b*), a supporting constitution of the coil unit 70 will be described more specifically. From FIGS. 3(*a*) and 3(*b*), the frame 25 is omitted. The coil unit 70 is urged toward the belt unit 24 by a reaction force of the elastic springs 52L and 52R, which are the elastic members provided compressedly between the holder 76 and the top plate 52*b* on the driving side and the non-driving side, respectively. The urged coil unit 70 is positioned in a state in which the abutting portions 70K thereof abut against the abutting portions 24K on the driving side and the non-driving side. In this embodiment, the abutting portions 70K on the coil unit 70 side are provided integrally with the holder 76 on the driving side and the non-driving side. Further, the abutting portions 24K of the belt unit 24 are upper edge portions of the flange members 19L and 19R on the driving side and the non-driving side, respectively. In this embodiment, the abutting portions (positioning portions) 70K on the coil unit 70 side are provided at two positions on each of the driving side and the non-driving side (at four positions in total). Therefore, four positioning portions K1, K2, K3 and K4 at which the abutting portions 70K can abut against the abutting portions 24K of the belt unit 24 are present.

The positioning portions 70K are engaged with a projection (first projection) formed between the positioning portions K1 and K2 on the non-driving side and are engaged with a projection (second projection) formed between the positioning portions K3 and K4 on the driving side, so that the coil unit 70 is mounted on the belt unit 24. Here, the distance between the positioning portions 70K is larger than the distance between the positioning portions K1 and K2 by about 50 μm. By this constitution, the positional accuracy of the coil unit 70 relative to the belt unit 24 in the recording-material conveyance direction can be enhanced. As a result, the coil unit 70 is urged toward the belt unit 24 and at the same time, the positioning portions receive the urging force.

However, actually, due to warpage of parts or thermal deformation during a sheet-passing job, the urging force is not uniformly exerted at four points on the same plane so that the abutting portions 70K of the coil unit 70 are stably present at the four points, and thus the abutting portions 70K are supported at three points. That is, there are four receiving portions but the abutting portions 70K contact at the three receiving portions. The mounting point (contact point) may be moved by the thermal deformation. When the belt unit 24 and the coil unit 70 are connected to each other by screws or the like, the shape of the fixing nip N is influenced by the warpage or the like of the coil unit 70 as described above. As a result, the shape of the fixing nip N is not stabilized, so that creases are generated in the recording material P in some cases. In this embodiment, the reason why the four positioning portions K, not the three positioning portions K are provided is that contact between the coil unit 70 and the belt 20 caused due to the warpage or the like of the coil unit 70 can be obviated. In this embodiment, in order to improve the heat generating efficiency, the coil unit 70 and the belt 20 are brought near to each other as close as possible. However, during the sheet-passing job, the temperature distribution of the coil unit 20 is changed and therefore when an unsupported portion of the coil unit 70 is warped toward the belt 20, the unsupported portion contacts the belt 20. As a result, the belt 20 is damaged. Therefore, in this embodiment, in order to prevent the belt 20 from contacting the coil unit 70, the positioning portions K are provided at four points in total at end portions of the belt 20. In this embodiment, the coil unit 70 is urged toward the belt unit 24 by the elastic springs 52L and 52R, so that even when the warpage of the coil unit 70 occurs, the abutting portions are abutted at three points. The three points of the abutting portions may vary depending on the change in thermal deformation of the coil unit 70. Further, in order that the belt unit 24 is not deformed by the elastic force of the elastic springs 52L and 52R and by the twisting moment generated by the three positioning portions, the belt unit 24 is configured to have high rigidity and the elastic springs 52 are configured to have a low elastic force. That is, the rigidity of the belt unit 24 is higher (larger) than the elastic force of the elastic springs 52L and 52R and the twisting moment generated by the three positioning portions. The coil unit 70 may cause the warping.

Embodiment 2

Figure 4:
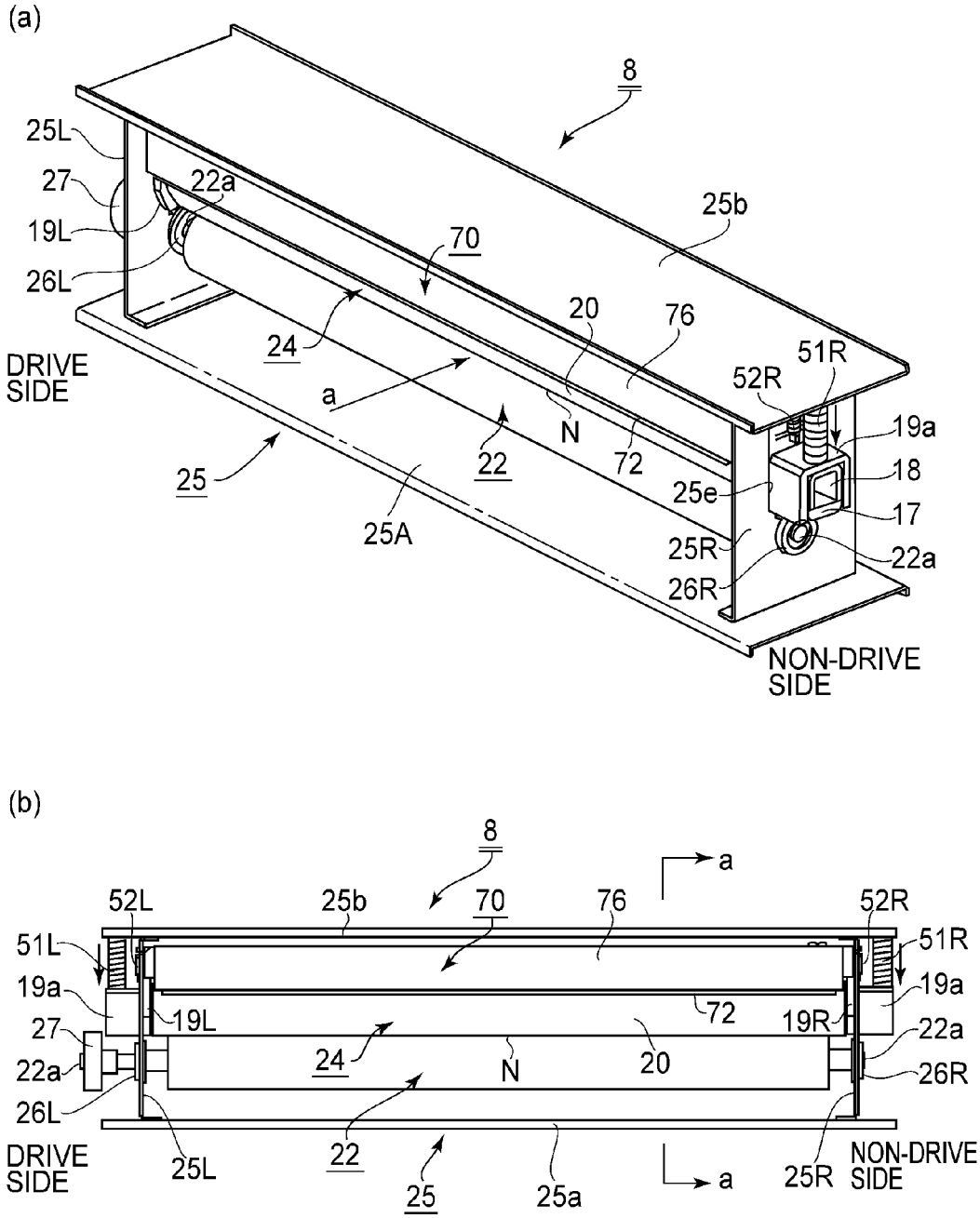
FIG. 4(*a*) is a perspective view of a fixing device in Embodiment 2 as seen from the front surface side (recording-material entrance side), and FIG. 4(*b*) is a schematic front view of the fixing device.
Figure 5:
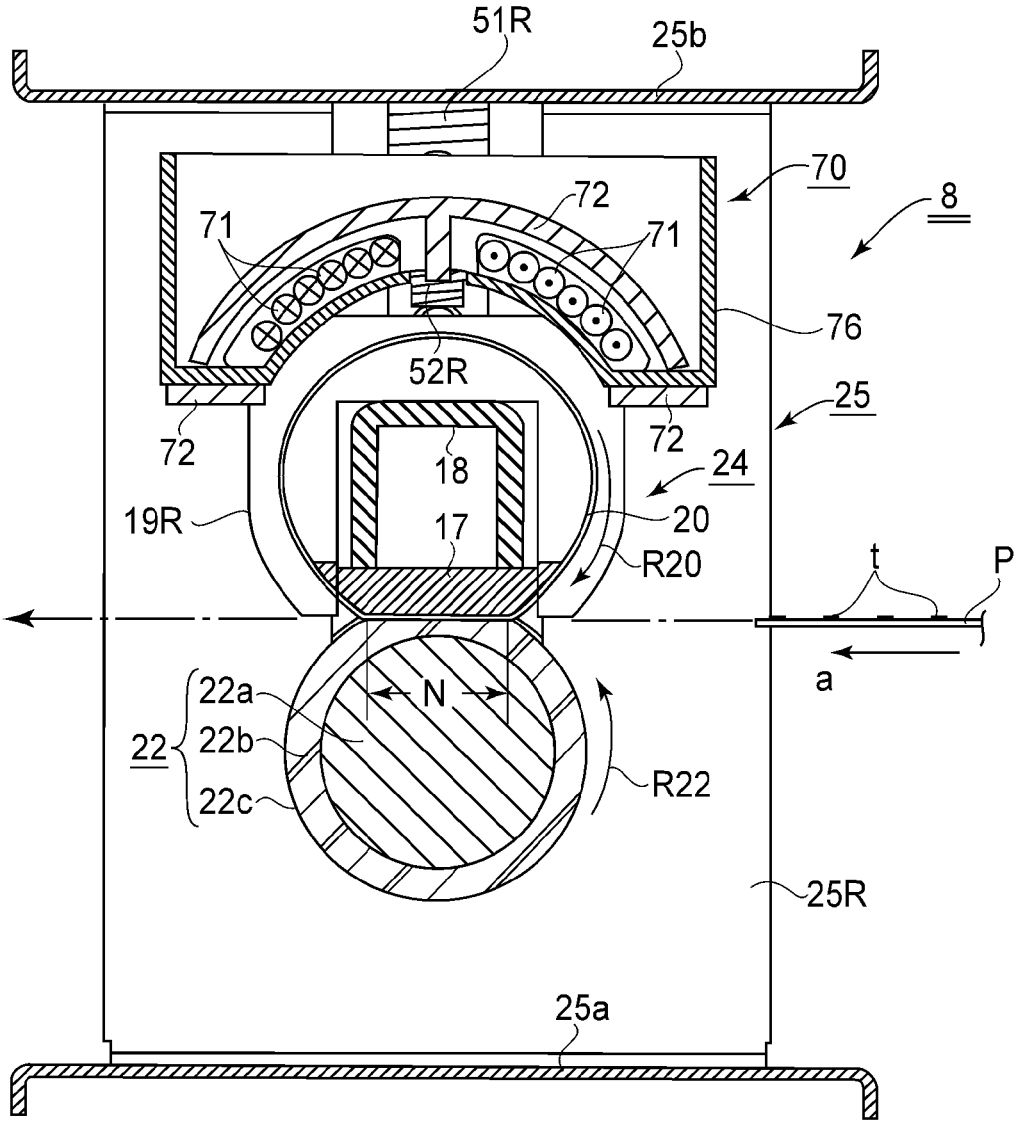
FIG. 5 is an enlarged cross-sectional left side view taken along a-a line indicated in FIG. 4(*b*).
Figure 6:
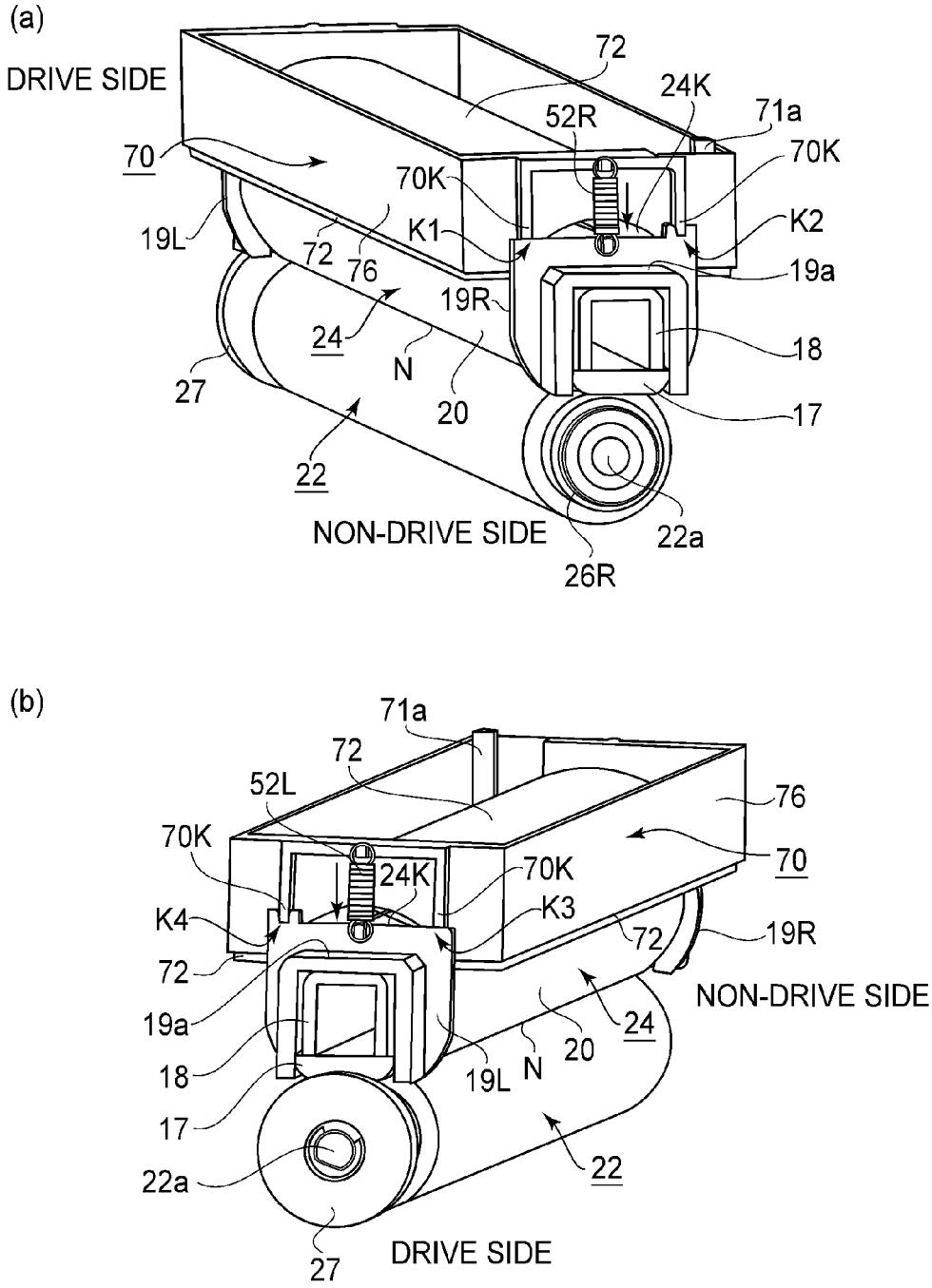
FIG. 6(*a*) is a schematic perspective view of an assembly portion in a fixing-device frame as seen from the non-driving side, and FIG. 6(*b*) is a schematic perspective view of the assembly portion as seen from the driving side.

FIGS. 4(*a*), 4(*b*), 5, 6(*a*) and 6(*b*) are schematic views for illustrating the fixing device 8 in this embodiment. FIG. 4(*a*) is a perspective view of the fixing device 8 in Embodiment 2 as seen from the front surface side (recording-material entrance side), and FIG. 4(*b*) is a schematic front view of the fixing device. FIG. 5 is an enlarged cross-sectional left side view taken along a-a line indicated in FIG. 4(*b*). FIG. 6(*a*) is a schematic perspective view of an assembly portion in a fixing-device frame as seen from the non-driving side, and FIG. 6(*b*) is a schematic perspective view of the assembly portion as seen from the driving side. In this embodiment, constituent elements and portions of the fixing device 8 common to Embodiment 1 are represented by the same reference numerals or symbols and will be omitted from redundant description. In the fixing device 8 in this embodiment, the roller 22 as the pressing member in positioned and rotatably supported by the fixing-device frame 25. That is, the left and right end portions of the metal core 22*a* of the roller 22 are rotatably supported by the bearing members 26L and 26R which are fixedly positioned and provided opposed to the left and right side plates 25L and 25R of the frame 25, respectively. The stay covering portions 19*a* of the left and right flange members 19L and 19R of the belt unit 24 are slidably disposed vertically along vertical elongated holes 25*e* provided opposed to the left and right side plates 25L and 25R, respectively. Further, the urging springs 51L and 51R are provided compressedly between the top plate 25 and the stay covering portion of the left flange member 19L and between the top plate 25*a* and the stay covering portion of the right flange member 19R, respectively. The left and right flange members 19L and 19R are urged upward by reaction force of the urging springs 51L and 51R provided compressedly, so that the pad 17 is urged against the belt 20 toward the upper surface of the roller 22 with a predetermined urging force. In this embodiment, the pad 17 is urged against the belt 20, against elasticity of the elastic layer of the roller 22, toward the upper surface of the roller 22 with a force of 98 N (10 kgf) on one side, i.e., with a total pressure of 196 N (20 kgf). As a result, between the belt 20 and the roller 22, with respect to a recording-material conveyance direction a, a fixing nip N with a predetermined width necessary for heat-fixation is formed. The coil unit 70 is urged toward the belt unit 24 by tension of elastic springs (elastic members) 52L and 52R each stretched between the coil unit 70 and the belt unit 24. The coil unit 70 urged toward the belt unit 24 is positioned in a state in which abutting portions 70K of the coil unit 70 abut against abutting portions 24K of the belt unit 24. This will be described later. The fixing device 8 in this embodiment is of a pressing-member driving type. That is, a driving gear 27 is disposed at the driving-side end portion (left end portion) of the metal core 22*a* of the belt 22. The roller 22 is rotationally driven in the counterclockwise direction indicated by an arrow R22 in FIG. 5 at a predetermined peripheral speed by a driving force from a driving means (not shown). A rotational force acts on the belt 20 by a press-contact frictional force in the nip N between the outer surface of the roller 22 and the belt 20 by rotationally driving the roller 22. As a result, the belt 20 is rotated by the rotation of the roller 22, thus being placed in a rotation state in which the belt 20 is rotated around the pad 17 and the stay 18 while sliding on the downward surface of the pad 17 on its inner surface side in intimate contact with the pad 17. Onto the inner surface of the belt 20, a grease is applied, so that a sliding property between the pad 17 and the inner surface of the belt 20 is ensured. The fixing operation of the fixing device 8 in this embodiment is similar to that of the fixing device 8 in Embodiment 1, thus being omitted from description.

Next, with reference to FIGS. 6(*a*) and 6(*b*), a supporting constitution of the coil unit 70 will be described more specifically. From FIGS. 6(*a*) and 6(*b*), the frame 25 is omitted. The coil unit 70 is urged toward the belt unit 24 by tension of the elastic springs 52L and 52R, which are the elastic members extended between the holder 76 and the flange members 19L and 19R on the driving side and the non-driving side, respectively. The urged coil unit 70 is positioned in a state in which the abutting portions 70K thereof abut against the abutting portions 24K on the driving side and the non-driving side. That is, the coil unit 70 is attracted toward the belt unit 24 by the elastic springs 52L and 52R which are the elastic member in the form of a tension spring. The attracted coil unit 70 is positioned in a state in which the abutting portions 70K thereof abut against the abutting portions 24K of the belt unit 24. In this embodiment, the abutting portions 70K on the coil unit 70 side are provided integrally with the holder 76 on the driving side and the non-driving side. Further, the abutting portions 24K of the belt unit 24 are upper edge portions of the flange members 19L and 19R on the driving side and the non-driving side, respectively. In this embodiment, the abutting portions (positioning portions) 70K on the coil unit 70 side are provided at two positions on each of the driving side and the non-driving side (at four positions in total). Therefore, four positioning portions K1, K2, K3 and K4 at which the abutting portions 70K can abut against the abutting portions 24K of the belt unit 24 are present. Here, in this embodiment, the coil unit 70 is positioned by the belt unit 24 in areas of the positioning portions K2 and K4 with respect to a recording-material conveyance direction a. In this embodiment, the reason why the four positioning portions K, not the three positioning portions is the same as that in the case of the fixing device 8 in Embodiment 1, thus being omitted from description.

Embodiment 3

Figure 7:
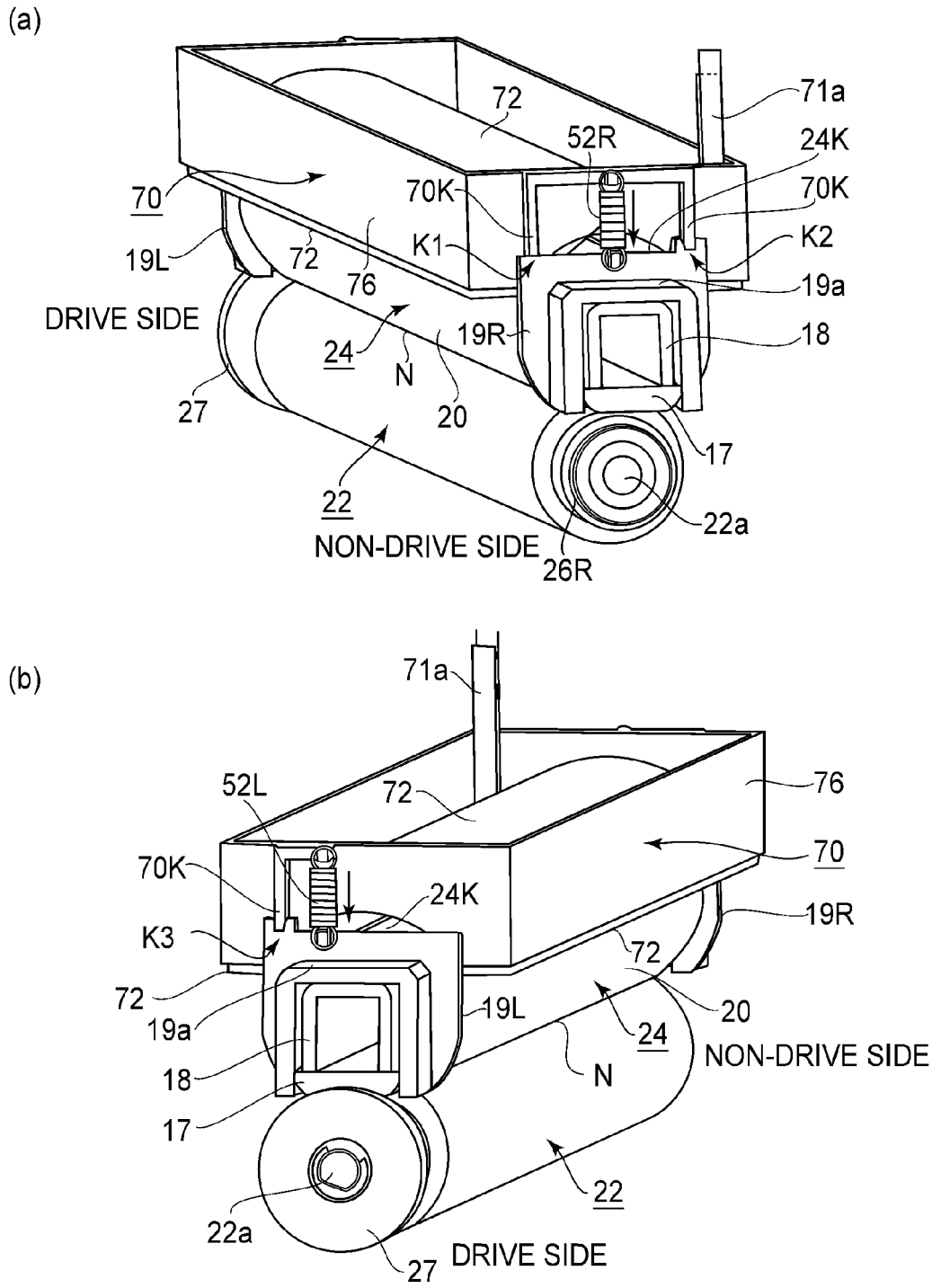
FIG. 7(*a*) is a schematic perspective view of an assembly portion in a fixing-device frame of a fixing device in Embodiment 3 as seen from the non-driving side, and FIG. 7(*b*) is a schematic perspective view of the assembly portion as seen from the driving side.
Figure 8:
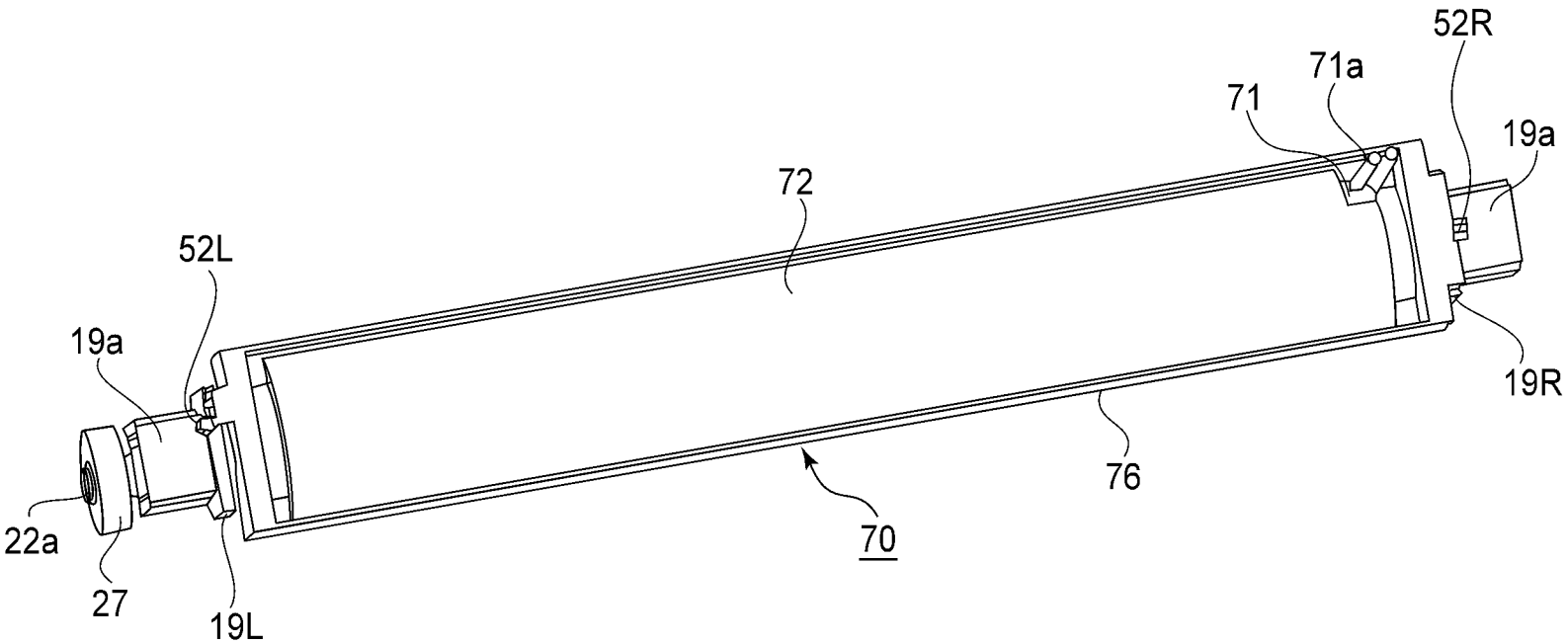
FIG. 8 is a perspective view of a coil unit as seen from above the coil unit.

FIGS. 7(*a*), 7(*b*) and 8 are schematic views for illustrating the fixing device 8 in Embodiment 3. FIG. 7(*a*) is a schematic perspective view of an assembly portion in a fixing-device frame of a fixing device in Embodiment 3 as seen from the non-driving side, and FIG. 7(*b*) is a schematic perspective view of the assembly portion as seen from the driving side. FIG. 8 is a perspective view of a coil unit as seen from above the coil unit. The fixing device 8 in this embodiment is of the pressing-member driving type similarly as in the fixing device 8 in Embodiment 2. Only the difference from the fixing device 8 in Embodiment 2 will be described. On the non-driving side, as shown in FIG. 7(*a*), the coil unit 70 is provided with two positioning portions 70K. On the other hand, on the driving side, as shown in FIG. 7(*b*), the coil unit 70 is provided with one positioning portion 70K. Therefore, three positioning portions K1, K2 and K3 at which the positioning portions 70K can abut against the abutting portions 24K of the belt unit 24 are present. In this embodiment, the positioning is performed at the three positions as described above, so that the shape of the nip N is not influenced by warpage or the like of the coil unit 70. Further, in this embodiment, even when a portion at which the positioning portion of the coil unit 70 is not present is warped during the job, a gap between the coil unit 70 and the belt unit 24 is provided so that the coil unit 70 does not contact the belt 20. In this embodiment, in areas of the positioning portions K2 and K3, the coil unit 70 is positioned by the belt unit 24 with respect to the recording-material conveyance direction a. Further, in order that the belt unit 24 is not deformed by the elastic force of the elastic springs 52L and 52R and by twisting moment generated by the three positioning portions, the belt unit 24 is configured to have high rigidity and the elastic springs 52L and 52R are configured to have a low elastic force.

On the driving side where the coil unit 70 abuts against the belt unit 24 at one position, the gap between the belt 20 and the coil 71 is always unstable due to the warpage of the coil unit 70. Therefore, when the belt 20 and the coil 71 are spaced from each other, the heat generating efficiency is lowered. Further, on the other hand, in order to connect the coil 71 to the energization portion (not shown), the core wire 71*a* is required to be led to the outside of the coil unit 70 from one of the driving side and the non-driving side of the coil unit 70. Therefore, as shown in FIG. 8, in order to lead out the core wire 71*a*, a part of the core 72 close to the core wire 71*a* is required to be removed. Further, it is also difficult to stably fix the core wire 71*a*. In this case, on the side where the core wire 71*a* is present, compared with the side where there is no core wire 71*a*, the heat generating efficiency is liable to be lowered. In this embodiment, in order to solve this problem, with respect to the direction in which the core wire 71*a* is led out, the two positioning portions K1 and K2 are provided to stabilize the gap between the coil 71 and the belt 20, so that the lowering in heat generating efficiency is prevented (FIG. 7(*a*)). That is, in the plane including the nip N, with respect to the direction perpendicular to the recording-material conveyance direction a, the two positioning portions K1 and K2 and the three positioning portions K1, K2 and K3 are provided on the side where the core wire 71*a* of the coil 71 of the coil unit 70 is led out.

Other Embodiments

1) It is possible to employ a constitution in which both of the belt 20 and the roller 22 are rotationally driven.

2) The belt 20 may also be a rigid sleeve member.

3) The pressing member 22 may also be a non-rotatable member. Further, in the case of the rotatable member, the pressing member is not limited to the roller but may also be an endless belt.

4) The fixing device may also be of an internal-heating type in which the induction-heat generating means 70 is disposed inside the belt 20.

5) The image forming apparatus and the fixing device may be structured so that the recording material is conveyed on a center line basis or on one side edge basis.

6) Not only can an image forming apparatus in accordance with the present invention be used as an image heat-fixing apparatus, such as those in the preceding embodiments, but also, as an image heating apparatus for heating the recording material on which an image is carried, to improve the image in surface properties, such as glossiness, an image heating apparatus for temporarily fixing an image, an image heating apparatus for quickly drying the ink of which an image is formed by an image forming apparatus, such as an ink jet image forming apparatus, which uses liquid which contains dye or pigment.

7) The process for forming the image t on the recording material P is not limited to the electrophotographic process of the transfer type but may also be other processes such as an electrostatic process, magnetic process, etc.

According to the present invention, the induction-heat generating means is urged toward the fixing belt unit by the elastic member, so that it is possible to reduce the degree of heat generation non-uniformity by a change in the gap between the coil and the heat generating member due to warpage (tension) caused by heat or the like of the induction-heat generating means.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 290493/2009 filed Dec. 22, 2009, which is hereby incorporated by reference.

What is claimed is:

1. An image heating apparatus comprising:

a belt unit including an endless belt configured to heat a toner image on a sheet at a nip portion;

a coil unit, provided opposed to an outer surface of said endless belt, including a coil configured to generate a magnetic flux for heating said endless belt;

a rotatable driving member configured to drive said endless belt to rotate and form the nip portion cooperatively with said endless belt;

a positioning mechanism configured to position said coil unit with respect to said belt unit, said positioning mechanism including four positioning portions in which two portions are provided on one side of said coil unit with respect to a longitudinal direction of said coil unit and the other two portions are provided on the other side of said coil unit with respect to the longitudinal direction; and an urging mechanism configured to urge said coil unit toward said belt unit, wherein said coil unit is supported by said belt unit at three of said four positioning portions.

2. An apparatus according to claim 1, wherein said belt unit has a rigidity which is higher than a twisting moment generated by an urging force of said urging mechanism and by which said coil unit is supported by said belt unit at the three of said four positioning portions.

3. An apparatus according to claim 1, wherein two of said three positioning portions are disposed on a side where a core wire of the coil of said coil unit is to be pulled out in a direction perpendicular to a sheet conveyance direction in a plane including the nip portion.

4. An apparatus according to claim 1, further comprising a back-up member provided inside said endless belt and configured to back up said endless belt toward said rotatable driving member in the nip portion and further comprising a flange configured so support said back-up member, wherein said three positioning portions are engaged with said flange.

5. An apparatus according to claim 1, wherein said urging mechanism includes two urging members configured to urge both longitudinal end sides of said coil unit toward said belt unit respectively.

6. An apparatus according to claim 5, wherein each of said two urging members is a spring.

7. An image heating apparatus comprising:

a belt unit including an endless belt configured to heat a toner image on a sheet at a nip portion;

a coil unit, provided opposed to an outer surface of said endless belt, including a coil configured to generate a magnetic flux for heating said endless belt;

a rotatable driving member configured to drive said endless belt to rotate and form the nip portion cooperatively with said endless belt;

at least three positioning portions provided on said coil unit and configured to position said coil unit with respect to said belt unit; and an urging mechanism configured to urge said coil unit toward said belt unit, wherein said coil unit is supported by said belt unit at three of said positioning portions, and wherein said belt unit has a rigidity which is higher than a twisting moment generated by an urging force of said urging mechanism and by engagement of said three positioning portions with said belt unit.

8. An apparatus according to claim 7, wherein two of said three positioning portions are disposed on a side where a core wire of the coil of said coil unit is to be pulled out in a direction perpendicular to a sheet conveyance direction in a plane including the nip portion.

9. An apparatus according to claim 7, further comprising a back-up member, provided inside said endless belt and configured to back-up said endless belt toward said rotatable driving member in the nip portion and further comprising a flange configured to support said back up member, wherein said three positioning portions are engaged with said flange.

10. An apparatus according to claim 7, wherein said urging mechanism includes two urging members configured to urge both longitudinal end sides of said coil unit toward said belt unit respectively.

11. An apparatus according to claim 10, wherein each of said two urging members is a spring.

12. An image heating apparatus comprising:

a belt unit including an endless belt configured to heat a toner image on a sheet at a nip portion;

a coil unit, provided opposed to an outer surface of said endless belt, including a coil configured to generate a magnetic flux for heating said endless belt;

a rotatable driving member configured to drive said endless belt to rotate and form the nip portion cooperatively with said endless belt;

at least three positioning portions provided on said coil unit and configured to position said coil unit with respect to said belt unit; and an urging mechanism configured to urge said coil unit toward said belt unit, wherein said coil unit is supported by said belt unit at three of said positioning portions; and wherein two of said three positioning portions are disposed on a side where a core wire of the coil of said coil unit is to be pulled out in a direction perpendicular to a sheet conveyance direction in a plane including the nip portion.

13. An apparatus according to claim 12, further comprising a back-up member, provided inside said endless belt and configured to back-up said endless belt toward said rotatable driving member in the nip portion and further comprising a flange configured to support said back up member, wherein said three positioning portions are engaged with said flange.

14. An apparatus according to claim 12, wherein said urging mechanism includes two urging members configured to urge both longitudinal end sides of said coil unit toward said belt unit respectively.

15. An apparatus according to claim 12, wherein each of said two urging member is a spring.

* * * * *